US005421305A

United States Patent [19]

Tomisawa

[11] Patent Number: 5,421,305

[45] Date of Patent: Jun. 6, 1995

[54] METHOD AND APPARATUS FOR CONTROL OF A FUEL QUANTITY INCREASE CORRECTION AMOUNT FOR AN INTERNAL COMBUSTION ENGINE, AND METHOD AND APPARATUS FOR DETECTION OF THE ENGINE SURGE-TORQUE

[75] Inventor: Naoki Tomisawa, Atsugi, Japan

[73] Assignee: Unisia Jecs Corporation, Atsugi, Japan

[21] Appl. No.: 186,576

[22] Filed: Jan. 26, 1994

[30] Foreign Application Priority Data

Jan. 28, 1993 [JP] Japan ..... 5-012725
Feb. 2, 1993 [JP] Japan ..... 5-015667

[51] Int. Cl.[6] ..... F02D 41/06; F02M 7/00
[52] U.S. Cl. ..... 123/435; 123/436
[58] Field of Search ..... 123/435, 436, 492, 493

[56] References Cited

U.S. PATENT DOCUMENTS 4,944,271 7/1990 Iwata et al. ..... 123/435
5,107,814 4/1992 Nishiyama et al. ..... 123/435
5,134,981 8/1992 Takahashi et al. ..... 123/492
5,134,983 8/1992 Kusunoki et al. ..... 123/492
5,224,452 7/1993 Tomizawa ..... 123/436
5,261,370 11/1993 Ogawa et al. ..... 123/492
5,265,575 11/1993 Norota ..... 123/436
5,331,933 7/1994 Matsushita ..... 123/435
5,353,764 10/1994 Tomisawa ..... 123/435

*Primary Examiner*—Willis R. Wolfe
*Attorney, Agent, or Firm*—Foley & Lardner

[57] ABSTRACT

A water temperature base increase correction amount for an internal combustion engine is reducingly corrected while maintaining the level of the surge-torque below a fixed level. A time constant for updating of the reduction correction is set based on a delay time from supply of fuel until generation of torque from combustion of the fuel. In this way responsiveness to the fuel reduction correction can be maintained, enabling improvement in fuel costs and exhaust emissions. Furthermore, the detection of the surge-torque necessary for example, for the control of fuel reduction correction, involves detection of scatter in combustion pressures between cylinders, while at the same time detecting variations in combustion pressure occurring in the same cylinder. The surge-torque level is then detected on the basis of these results. Since the influence or the occurrence of surge-torque is greater at low speed in the case of the former, and at high speed in the case of the latter, good surge-torque detection can be achieved over the whole operating range.

22 Claims, 8 Drawing Sheets

METHOD AND APPARATUS FOR CONTROL OF A FUEL QUANTITY INCREASE CORRECTION AMOUNT FOR AN INTERNAL COMBUSTION ENGINE, AND METHOD AND APPARATUS FOR DETECTION OF THE ENGINE SURGE-TORQUE

FIELD OF THE INVENTION

The present invention relates to technology for controlling a gradual reduction of a fuel quantity increase correction amount in accordance with a generation level of surge-torque in an internal combustion engine. The invention also relates to technology for the accurate detection of the surge-torque.

DESCRIPTION OF THE RELATED ART

Conventionally, during warm up operation of an internal combustion engine, there is an increase in so called wall flow wherein fuel attaches to the internal wall of the inlet passage as a result of the low engine temperature, and also due to the low temperature of the combustion chamber, the fuel attaches to the combustion chamber wall. This has an adverse effect on the mixing of the fuel with the air. To maintain the air fuel mixture level, the fuel quantity is increased on the basis of water temperature, i.e. depending on the engine cooling water temperature.

In this regards, a conventional water temperature base increase correction coefficient KTW is by adding a correction amount for fuels of particularly low volatility, and a correction amount for variations in the components of the fuel supply system to a minimum required amount so that basically there is no deterioration in combustion. Concretely, a 30% rich mixture of the total increase correction amount with 25% for the former correction amount and +5% for the later correction amount is supplied to the minimum required amount.

Consequently, when a fuel of high volatility is used, and variations in the components of the fuel supply system are at a normal level, an excessively rich mixture is supplied, resulting in increased fuel costs and exhaust emissions.

Attempts have been made to reduce the fuel costs and improve exhaust emissions by detecting the surge-torque by some method, and setting the water temperature base increase correction amount to a minimum amount necessary to maintain the level of the surge-torque below a predetermined level. In these cases, the water temperature base increase correction amount is initially set large due to the uncertainty of the fuel used and the environmental conditions. Then with detection of the level of the surge-torque, the correction amount is gradually reduced to keep the surge-torque within a predetermined level.

When fuel is supplied to an engine from a valve such as a fuel injection valve, a delay occurs from supply of the fuel until torque is generated from its combustion. This delay time is a combination of the time for the fuel to pass via the intake passage to the combustion chamber, and the time from intake into the combustion chamber until combustion through the compression stroke. The former time is determined mainly by the engine rotational speed and intake flow velocity, while the latter time is determined by the engine rotational speed. Hence the delay time changes depending on operating conditions.

Accordingly, in the case of a reduction correction to a fuel quantity increase correction amount, it is necessary to carry out a further reduction correction after detection of the torque conditions due to combustion of the reduction corrected fuel.

However, the conventional reduction correction to the fuel quantity increase correction amount involves gradual reduction with a fixed time constant using an integral control having a fixed integration constant. As a result, the reduction correction is set to suit operating conditions which give the largest delay time to satisfy the beforementioned requirements. The response delay for normal operating conditions with a short delay time thus becomes excessively large.

SUMMARY OF THE INVENTION

In view of the foregoing, an object of the present invention is to be able to appropriately set the rate of reduction of a fuel quantity increase correction amount irrespective of changes in operating conditions of an engine, to thereby maintain good response.

It is a further object of the present invention to be able to accurately detect the surge-torque needed at such times as when setting the fuel quantity increase correction amount.

To achieve the first objective, the method and apparatus according to the present invention for the control of a fuel quantity increase correction amount for an internal combustion engine comprises:

a surge-torque detection step or device for detecting a level of surge-torque of the engine;

an increase correction amount gradual reduction control step or device for decrementally correcting of the fuel quantity increase correction amount previously set large, while maintaining the detected surge-torque below a predetermined level;

an operating conditions detection step or device for detecting operating conditions of the engine;

a torque generation delay time estimation step or device for estimating on the basis of the operating conditions of the engine, a delay time from supply of fuel to the engine until torque is generated from combustion of said fuel; and a reduction time constant setting step or device for setting on the basis of the estimated delay time, a time constant for control of reduction of the fuel quantity increase correction amount by the increase correction amount gradual reduction control step or device.

With such a construction, the fuel quantity increase correction amount previously set large is gradually reduced, while maintaining the detected surge-torque below a predetermined level, and the time constant for the reduction control is set as follows by the reduction time constant setting step or device.

That is to say, the torque generation delay time estimation step or device, estimates the delay time from supply of fuel to the engine until torque is generated from combustion of said fuel, on the basis of the operating conditions detected by the operating conditions detection step or device. A time constant for control of reduction of the fuel quantity increase correction amount, is then set on the basis of the estimated delay time.

The increase correction amount gradual reduction control step or device reducing corrects the fuel quantity increase correction amount. It then makes a subsequent reduction correction which is timed for immediately after an elapse of the delay time for generation of torque from combustion of the corrected fuel, to correspond to the torque condition. As a result, optimum response can be maintained without making control error.

The torque generation delay time estimation step or device may comprise: a first delay time estimation step or device for estimating a first delay time from supply of the fuel until it reaches the combustion chamber;

a second delay time estimation step or device for estimating a second delay time from intake of the fuel into the combustion chamber until combustion through the compression stroke; and a summing step or device for summing the estimated first and second delay times, and computing an overall delay time.

The first and second delay times are due to different causes. Hence, separation in this way and adding the estimated values to obtain the torque generation delay time, enables accurate determination of the delay time for generation of the torque from combustion of the corrected fuel.

For example, since the fuel after correction flows into the combustion chamber along the intake, the first delay time can be estimated with good accuracy by having a first delay time estimation step or device comprising:

a step or device for estimating the intake flow velocity based on the engine intake flow rate and engine rotational speed; and a step or device for estimating the first delay time as a functional value of the estimated intake flow velocity and the intake path length from the fuel supply point to the combustion chamber.

Normally the fuel supply points are all equal. Hence in this case, the first delay time estimation step or device may involve a structure for estimating the first delay time as a functional value of the engine intake flow rate and the engine rotational speed, thereby reducing estimation time.

The second delay time estimation step or device may involve a structure for estimating the second delay time on the basis of engine rotational speed.

This is because the second delay time from intake of fuel into the combustion chamber until combustion through the compression stroke depends on the piston speed, that is the engine rotational speed.

The reduction time constant setting step or device may involve setting a time constant proportional to the delay time estimated by the torque generation delay time estimation step or device.

That is to say, since the influence on the surge-torque from the corrected fuel becomes apparent after an elapse of the delay time, then setting the time constant to conform to the delay time enables the next fuel reduction correction to be carried out while verifying the post correction results.

To achieve the second objective, the surge-torque detection method or device according to the present invention comprises:

a combustion pressure variation detection step or device for detecting variable conditions of combustion pressure in a predetermined cylinder for each rotation;

a combustion pressure scatter detection step or device for detecting a scatter in combustion pressures occurring between a plurality of cylinders, and a surge-torque detection step or device for detecting a generation level of surge-torque using at least one of the detection results of said combustion pressure variation detection step or device, and said combustion pressure scatter detection step or device.

For example, in the high engine rotational speed range above a certain level detected by the operating conditions detection device, the generation of surge-torque is mainly influenced by combustion pressure variations in the same cylinder, for each rotation. However, in the low engine rotational speed range detected by the same operating conditions detection device, the generation of surge-torque is more significantly influenced by the scatter in combustion pressures occurring between the plurality of cylinders.

The surge-torque detection device is thus good for detecting a generation of surge-torque over all ranges of operating conditions on the basis of at least one of; the variable conditions of combustion pressure in the same cylinder detected by the combustion pressure variation detection device, and the scatter in combustion pressures occurring between the cylinders detected by the combustion pressure scatter detection device.

The combustion pressure variation detection step or device may for example comprise:

a step or device for sampling and storing a combustion pressure for each unit period within a predetermined range of crank angle intervals during the combustion stroke of one cylinder;

a step or device for computing a difference amount for each sampling, between a last stored combustion pressure Mi and a previously stored combustion pressure Mi-1, and computing and storing a sum $\Delta M$ ($=\Sigma(Mi-Mi\text{-}1)$) of the computed difference amounts from start of sampling up until the present;

a step or device for the Fourier transform of the sum $\Delta M$, for each computation of the sum $\Delta M$; and a step or device for selecting from the results of the Fourier transform, a level $\Delta P1$ of a frequency component "fn" related to the surge-torque, and storing this as a combustion pressure variation condition.

In such a construction, with the sampling period as a unit period, the levels for the various frequency components with periods of 1 to i times the unit period are obtained, enabling the level of the frequency component related to the surge-torque to be extracted with high accuracy.

Furthermore, the combustion pressure scatter detection step or device may for example comprise:

a step or device for reading in, for respective cylinders 1 through n, the detected values Mi1 through Min of combustion pressures occurring at identical crank angle timings (1 through i) in respective identical strokes;

a step or device for computing between all of the cylinders, a difference amount $\Delta Mi$ of the combustion pressures Mi1 through Min between said cylinders;

a step or device for the Fourier transform of the difference amount $\Delta Mi$ for each of the respective crank angle timings (1 through i); and a step or device for selecting from the results of the Fourier transform, a level $\Delta P2$ of a frequency component "fm" related to the surge-torque, and storing this as a scatter in the combustion pressures between the cylinders.

With such a construction, the scatter in the combustion pressures between the cylinders is obtained for each of the frequency components by the Fourier transform of the difference amount $\Delta Mi$, enabling the frequency component related to the surge-torque to be extracted with high accuracy from among these.

Moreover, the combustion pressure scatter detection step or device may comprise:

a step or device for detecting and storing, for respective cylinders 1 through n, an engine rotational speed Ni for each identical crank angle timing in respective identical strokes;

a step or device for computing a difference amount between a last stored Ni and a previously stored Ni-1, and computing and storing a sum $\Delta N$ ($=\Sigma(Ni-Ni\text{-}1)$) of the computed difference amounts from start up until the present;

a step or device for the Fourier transform of the sum $\Delta N$ for each computation of said sum $\Delta N$; and a step or device for selecting from the results of said Fourier transform, a level $\Delta P2$ of a frequency component "fm" related to the surge-torque, and storing this as a combustion pressure scatter between the cylinders.

The direct detection of scatter in the combustion pressures occurring in the high speed range between the cylinders is practically difficult timing wise, and is also susceptible to large computational errors. Furthermore, it is necessary to provide a combustion pressure detection device for each cylinder, thereby increasing costs. Although it may be possible to have only one detection device, with sampling made for a predetermined crank angle timing for each cylinder, due to a difference in combustion pressure level with cylinder distance from the sensor, accuracy is compromised. With the above mentioned construction of the present invention, the detection of combustion pressure is carried out for one specific cylinder only, and the scatter in combustion pressures between the cylinders is detected accurately by the variation in rotational speed with the period of the crank angle phase difference for respective cylinders.

Moreover, the construction may preferably comprise a fuel quantity increase correction amount learning step or device for continuing to store, for each termination of operation of the engine, even after termination of operation, the fuel quantity increase correction amount set at the termination time, and using this as an initial value for a subsequent operating time.

With such a construction, the fuel quantity increase correction amount stored for the previous operation time may be used as an initial value at the start of operation. As a result, the time until convergence due to the reduction correction may be shortened, so that improvement results in fuel costs and exhaust emissions can be improved.

As follows is a disclosure of embodiments of the present invention which describe the present invention in detail. Needless to say however, the present invention also includes the various aspects contained within the scope as indicated in the claims.

DETAILED DESCRIPTION OF THE PREFERRED EMBODIMENTS

A description of the preferred embodiments according to the present invention is given below with reference to the drawings.

Figure 1:
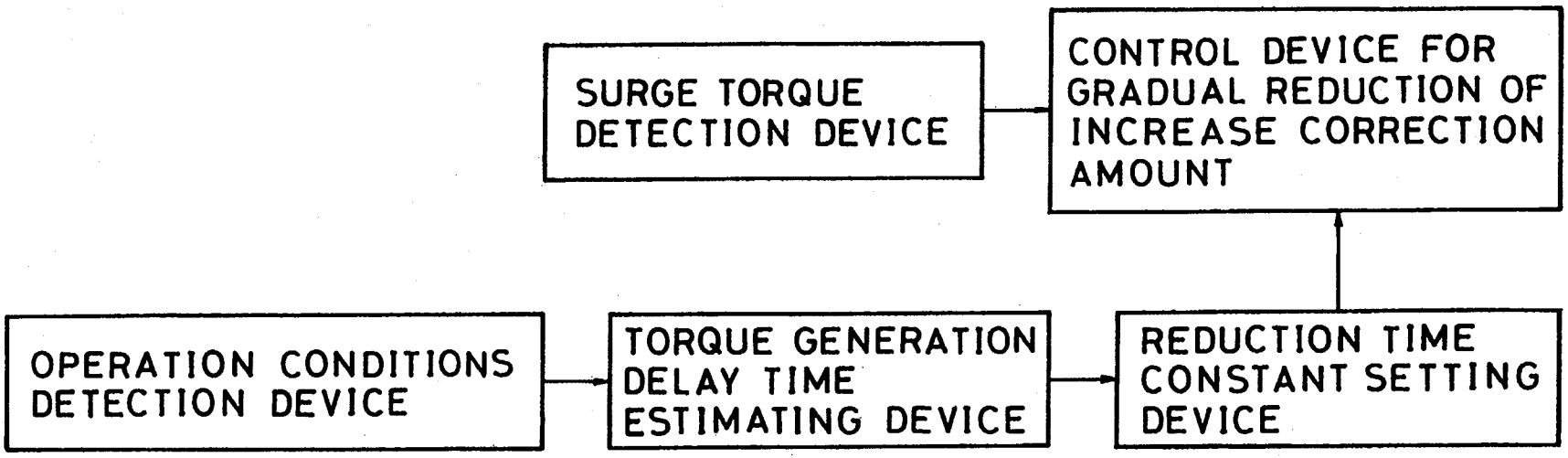
FIGS. 1(A) and 1(B) are block diagrams illustrating a structure and function of the present invention.
Figure 1B:
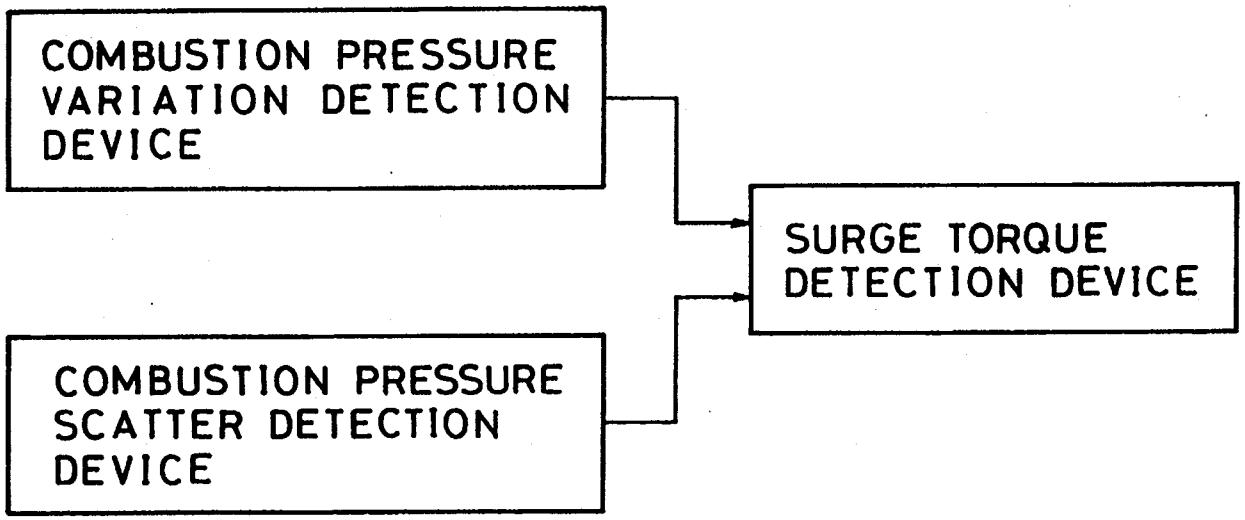
Figure 2:
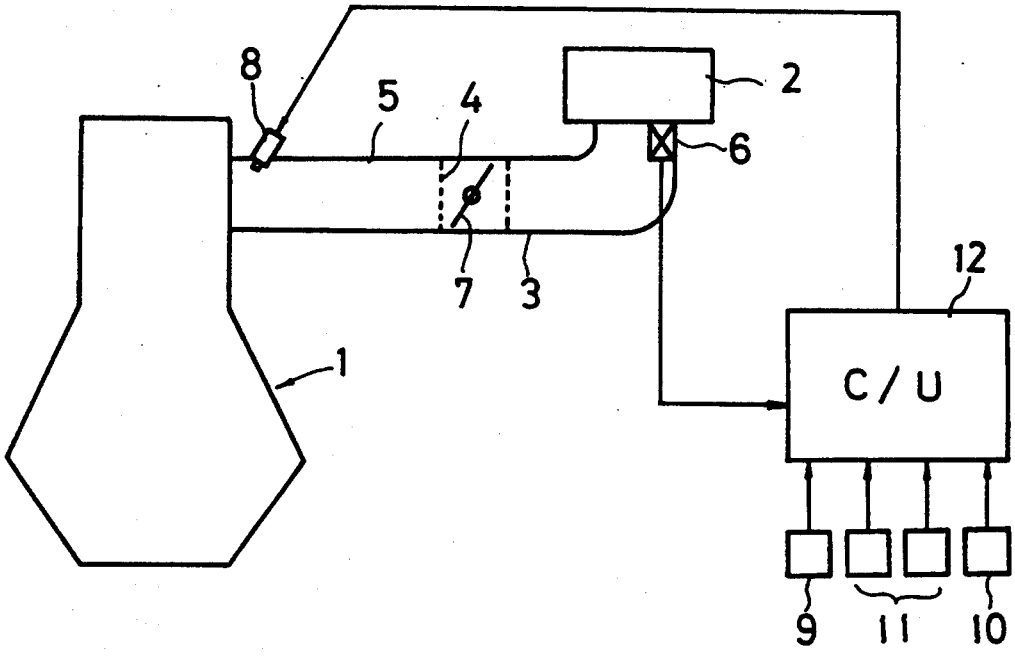
FIG. 2 is a diagram illustrating a hardware arrangement of the present invention.

In FIG. 2 which illustrates a hardware arrangement of a first embodiment, air is supplied to an internal combustion engine 1 by way of an air cleaner 2, an intake duct 3, a throttle chamber 4, and an intake manifold 5.

An air flow meter 6 is provided in the intake duct 3 to detect an intake flow rate Q. The throttle chamber 4 is provided with a throttle valve 7 connected to an accelerator pedal (not shown in the figure) to thereby control the intake flow rate Q.

Solenoid type fuel injection valves 8 are provided in the intake manifold 5 as fuel injection devices for each cylinder. The injection valves 8 inject fuel which is supplied under pressure from a fuel pump and controlled to a predetermined pressure by a pressure regulator (both not shown in the figure).

Also provided is a crank angle sensor 9 for outputting a reference signal REF for each crank angle phase difference for each cylinder of the engine (i.e. 180° for a four cylinder engine), a water temperature sensor 10 for detecting a cooling water temperature of the engine, and a combustion pressure sensor 11 provided for each cylinder, for example in combination with a spark plug, for detecting a combustion pressure (cylinder pressure) of the respective cylinder. Detection signals from these sensors are input to a control unit 12 incorporating a microcomputer. The control unit 12 carries out surge-torque detection on the basis of the signals as follows, and sets the water temperature base increase correction coefficient KTW for the fuel. The before mentioned respective sensors constitute the operating conditions detection device.

Figure 3:
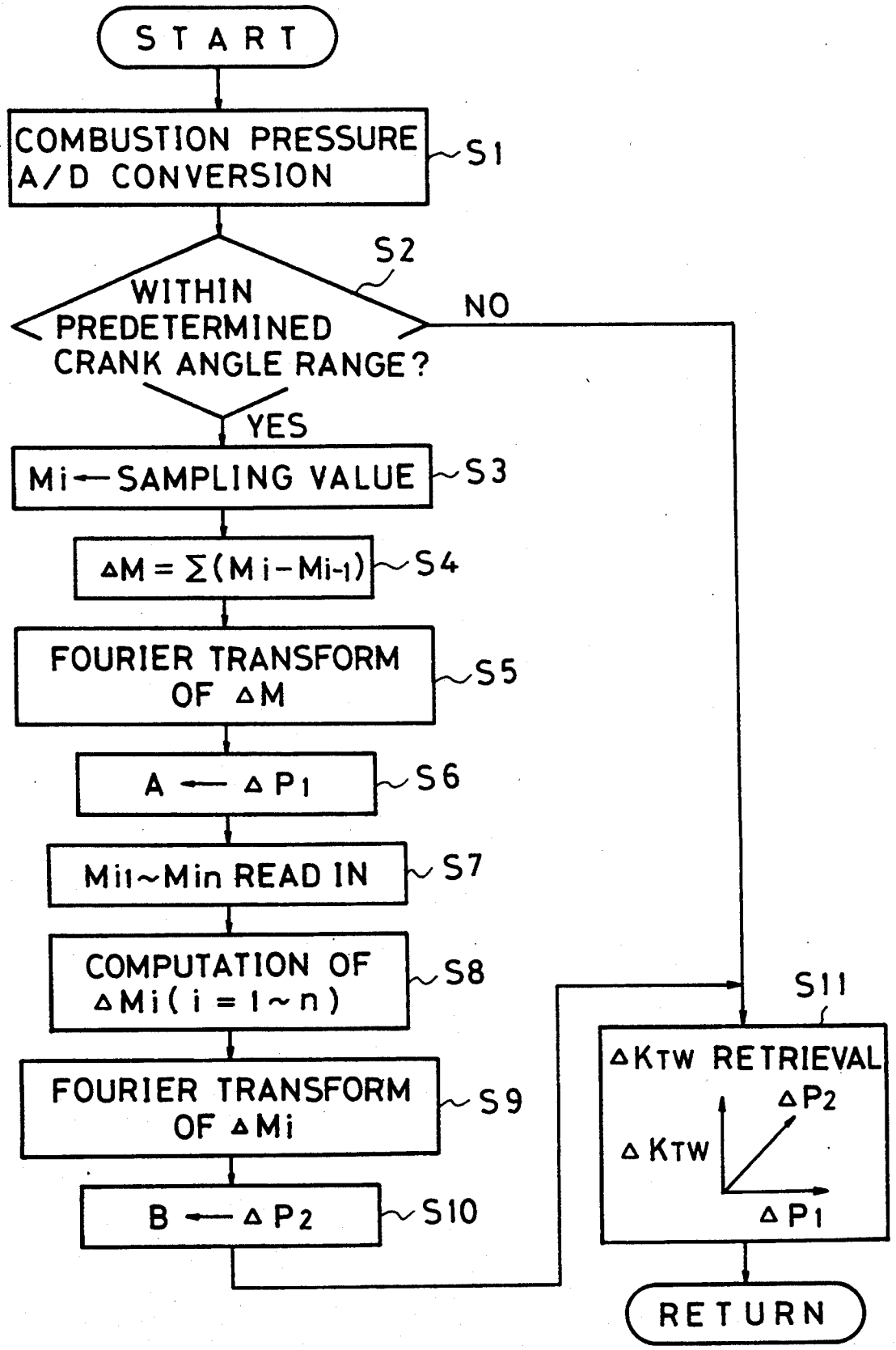
FIG. 3 is a flow chart for illustrating a routine of a first embodiment for surge-torque detection and for setting a reduction amount for a water temperature base increase correction coefficient using the detected surge-torque.

As follows is a description in accordance with FIG. 3, of a routine for setting a water temperature base increase correction coefficient KTW using surge-torque detection.

In step 1 (denoted by S1 in the figure with subsequent steps indicated in a similar manner), analog values of combustion pressure sampling values detected by the combustion pressure sensor 11 fitted to a cylinder making a combustion stroke are converted into digital signals for each predetermined time unit (e.g. 12.8 μs).

In step 2, it is judged on the basis of the crank angle sensor 9 detection signal, if the relevant cylinder is within a predetermined crank angle range of the combustion stroke.

If judged within the predetermined crank angle range, control proceeds to step 3, and the sampling values converted in step 1 are stored in a memory M as Mi.

In step 4, the sum ΔM (=Σ(Mi−Mi-1)) of the differences between the Mi and the previous Mi-1 is computed.

In step 5, the Fourier transform of the sum ΔM obtained in step 4 is obtained. From this, with the sampling period as a unit period, the levels for the various frequency components with periods of 1 to i times the unit period can be obtained.

In step 6, a level ΔP1 of a predetermined frequency component fn related to the surge-torque is selected from the results of the beforementioned Fourier transform, and stored in a memory A. In this case just the frequency component most related to the surge-torque is selected. However, a plurality of frequency components may be selected, and either simply added, or weighted and added, and the averaged value stored.

The parts of the above step 1 through step 6 correspond to the combustion pressure variation detection device for detecting the combustion pressure variation amount in a predetermined cylinder for each rotation.

Subsequently, in step 7 the detected values Mi1 through Min of combustion pressures occurring at identical crank angle timings in respective identical strokes are read for each of the respective cylinders 1 through n.

In step 8, the difference amounts ΔMi (scatter) of the combustion pressures (Mi1 through Min) between the cylinders are obtained for between all of the cylinders-,and these differences are all added. In this way the maximum scatter in combustion pressures between the cylinders is detected.

In step 9, the Fourier transform of the differences ΔMi for all of the "i"s occurring in the beforementioned predetermined crank angle range is obtained.

In step 10, a level ΔP2 of a predetermined frequency component fm related to the surge-torque is selected from the results of the beforementioned Fourier transform, and stored in the memory B. In this case also a plurality of values of frequency components may be either simply added, or weighted and added, and the averaged value stored.

The parts of the above step 7 through step 10 correspond to the combustion pressure scatter detection device for detecting the scatter in combustion pressures occurring between cylinders.

In this way, the combustion pressure variation amount in the same cylinder (ΔP1) is detected, and the combustion pressure scatter between cylinders (ΔP2) is detected. Then, in step 11, from a combination of the results, the reduction amount ΔKTW for the water temperature base increase correction coefficient KTW is set to correspond to the generation level of the surge-torque.?

Here, since the surge-torque generation level at the start of warm up is not known, an allowance is made by setting the water temperature base increase correction coefficient KTW to a higher value in the conventional manner. A method of gradually reducing the water temperature base increase correction coefficient KTW while detecting the surge-torque generation level is then carried out, with a reduction amount ΔKTW for each cycle set, based on the beforementioned detection of the combustion pressure variation amount occurring in the same cylinder, and detection of the scatter in combustion pressures occurring between the cylinders.

That is to say, a reduction amount ΔKTW corresponding to the surge-torque generation level is obtained by retrieval from the reduction amounts ΔKTW previously stored in the ROM using parameters of ΔP1 and ΔP2, on the basis of the combustion pressure variation amount ΔP1 occurring in the same cylinder and stored in memory A, and the combustion pressure scatter ΔP2 between the cylinders stored in memory B. Here in the engine low rotational speed range, ΔP1 is more related to the generation of surge-torque, while in the high rotational speed range, ΔP2 is more related to the generation of surge-torque. Consequently, if one or the other becomes large, or the total value of both is below a predetermined level, the level of the surge-torque is small, and the reduction amount ΔKTW, as the allowance for reduction of the water temperature base increase correction amount KTW can be set large. Moreover, since the allowance for reduction decreases as the level of the surge-torque approaches a limit value, the reduction amount ΔKTW is set smaller. Accordingly, the parts of step 11 are constructed so as to include the surge-torque detection device.

Figure 4:
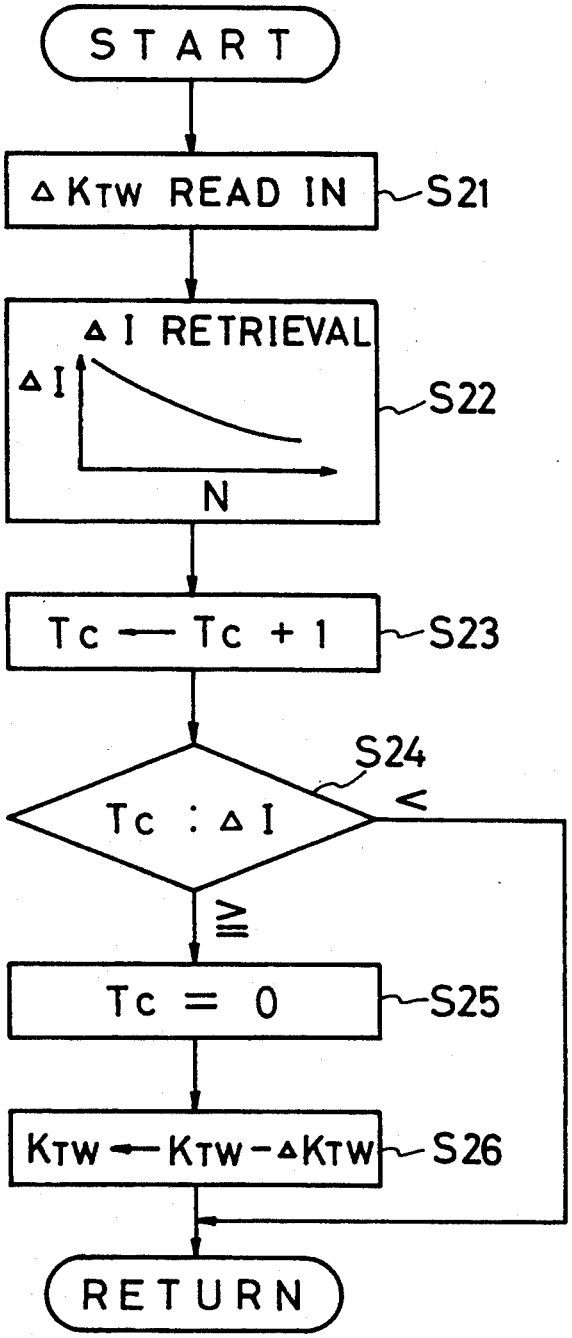
FIG. 4 is a flow chart for illustrating a first routine of the first embodiment for setting a time constant for the reduction of the water temperature base increase correction coefficient.

Next, is a description in accordance with the flow chart of FIG. 4, of a routine for setting a time constant Δl for the reduction by the reduction amount ΔKTW, and using this time constant to periodically reduction correct to the water temperature base increase correction amount KTW. This routine is carried out at a predetermined timing period.

In step 21, the reduction amount ΔKTW for the water temperature base increase correction amount KTW, set in the beforementioned routine is read in.

In step 22, a time constant Δl for the reduction by the reduction amount ΔKTW corresponding to the beforementioned delay time from supply of fuel until generation of the torque, is obtained based on the engine rotational speed N, by retrieval from a map previously obtained experimentally or analytically and stored in a ROM. Here since both the reduction delay for the time for the fuel to reach the combustion chamber, and the reduction delay for the time from intake into the combustion chamber until combustion through the combustion stroke both become shorter the faster the engine rotational speed N, the time constant Δl is set to reduce with the reduction delay for the time. That is to say, step 22 provides both the functions of the torque generation delay time estimation device and the reduction time constant setting device at the same time.

In step 23, the timer count is started.

In step 24, the timer count value Tc is compared with the beforementioned time constant Δl.

When the timer count value Tc is greater than or equal to the time constant Δl, control proceeds to step 25, and the count value Tc is reset. Control then proceeds to step 26 and the water temperature base increase correction coefficient KTW is updated to a value reduced by a correction of the beforementioned reduction amount ΔKTW. The function of step 23 through step 26 corresponds to the increase correction amount gradual reduction control device.

With such a construction, the time constant Δl for the reduction of the water temperature base increase correction coefficient KTW is set to conform to the delay time from supply of fuel until generation of the torque. Therefore after the appearance of a change in the torque due to the correction, the following reduction correction is carried out quickly in correspondence with the torque conditions As a result, good response can be maintained even at high speed, enabling an improvement in fuel costs and exhaust emissions.

With the beforementioned first embodiment, the time constant Δl for reduction is set from the engine rotational speed N only. However, as previously mentioned, the time from the supply of fuel until it reaches the combustion chamber is determined by the intake flow velocity which changes with the intake flow rate Q as well as with the engine rotational speed N.

Figure 5:
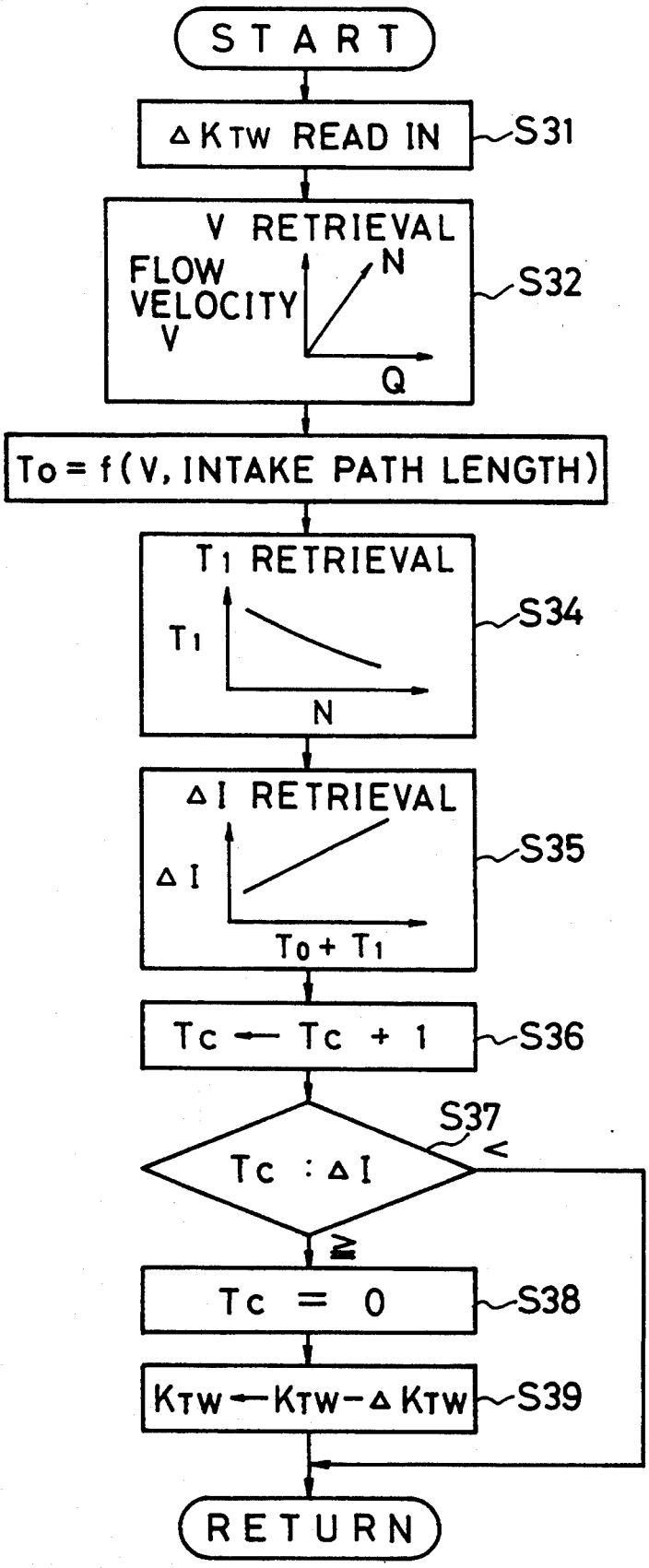
FIG. 5 is a flow chart for illustrating a second routine of the first embodiment for setting a time constant for the reduction of the water temperature base increase correction coefficient.

The routine of the second embodiment which takes this into consideration by setting the time constant Δl for reduction of the fuel to a higher accuracy, will be explained in accordance with FIG. 5.

In step 31, the reduction amount ΔKTW for the water temperature base increase correction coefficient KTW is read in, in a similar manner to that of step 21.

Then in step 32, an intake flow velocity "v" is obtained by retrieval etc. from a previously set map, on the basis of an engine rotational speed N and an intake flow rate Q.

In step 33, a first delay time T0 from the supply of the fuel until it reaches the combustion chamber is obtained as a functional value of the intake flow velocity "v" obtained in step 32 and the intake path length from the fuel supply point to the combustion chamber. Since the intake path length has a constant value when the supply point is fixed, the beforementioned functional value can be directly set in a map, in relation to the engine rotational speed N and intake flow rate.

In step 34, a second delay time T1 from the intake of fuel into the combustion chamber until combustion through the compression stroke is obtained by retrieval etc. from a map, on the basis of the engine rotational speed N.

In step 35, a time constant Δl for the reduction of the water temperature base increase correction coefficient KTW corresponding to a total delay time T being the sum of the first delay time T0 and the second delay time T1, is set by retrieval etc. from a map. Here the time constant Δl is needless to say set so as to increase proportionally with an increase of the total delay time T.

Step 36 through step 39, as with step 23 thorough step 26 of FIG. 4 of the previous embodiment, reduce the water temperature base increase correction coefficient KTW by reduction amounts ΔKTW for each elapsed time of the time constant Δl.

With the present embodiment, the delay time from the supply of fuel until the generation of torque can be more accurately grasped. Therefore, the setting of the time constant Δl to correspond to the delay time can be carried out with greater accuracy.

Figure 6:
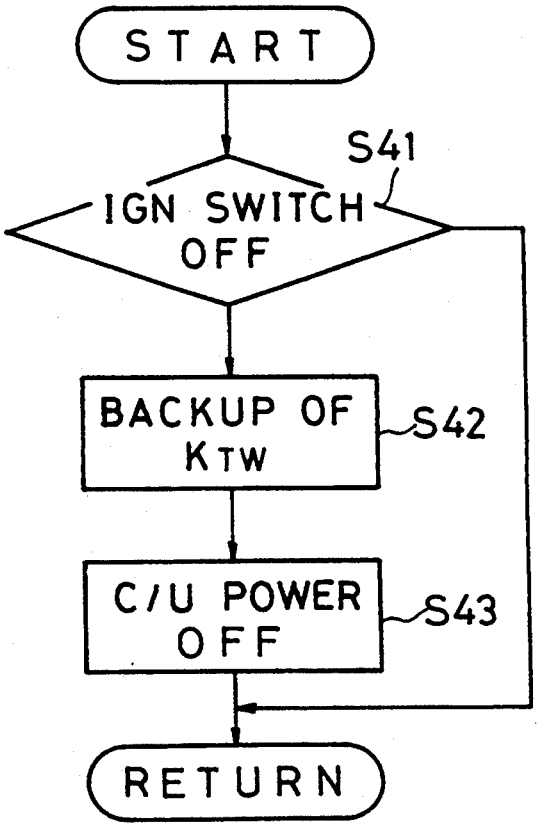
FIG. 6 is a flow chart for illustrating a routine of the first embodiment for learning a water temperature base increase correction coefficient.

FIG. 6 shows a routine for learning the water temperature base increase correction coefficient KTW. In step 41 the ignition switch is judged to be OFF. Then in step 42, the beforementioned reduction corrected water temperature base increase correction coefficient KTW is stored and kept in a backup RAM. Finally, in step 43, the control unit 12 power is switched off.

In this way, when the next operation starts, the water temperature base increase correction coefficient KTW stored in the backup RAM for the previous learning is used as the initial value. As a result, the time until convergence due to the reduction correction may be shortened, so that improvement results in fuel costs and exhaust emissions can be improved.

Next is a description of another embodiment for detecting the combustion pressure scatter between cylinders. The detection of the combustion pressure variation in the same cylinder is the same as for step 1 through step 6 of FIG. 3, while steps 7 through 10 of FIG. 3 are replaced by step 51 through step 53 of FIG. 7.

That is to say, as with the previous embodiment, the direct detection of scatter in the combustion pressures occurring in the high speed range, between the cylinders is practically difficult timing wise, and is also susceptible to large computational errors. Furthermore, it is necessary to provide a combustion pressure sensor 11 for each cylinder, thereby increasing costs. Although it may be possible to have only one combustion pressure sensor, with sampling made for a predetermined crank angle timing for each cylinder, due to a difference in combustion pressure level with cylinder distance from the sensor, accuracy is compromised. With the present embodiment, the combustion pressure sensor 11, is provided in only one specific cylinder, and the scatter in combustion pressures between the cylinders is detected by the variation in rotational speed with the period of the crank angle phase difference for respective cylinders. Here, since a reference signal is generated by the crank angle sensor 9 for each crank angle phase difference of the respective cylinders, the variation in rotational speed can be obtained for each input of the reference signal REF.

Figure 7:
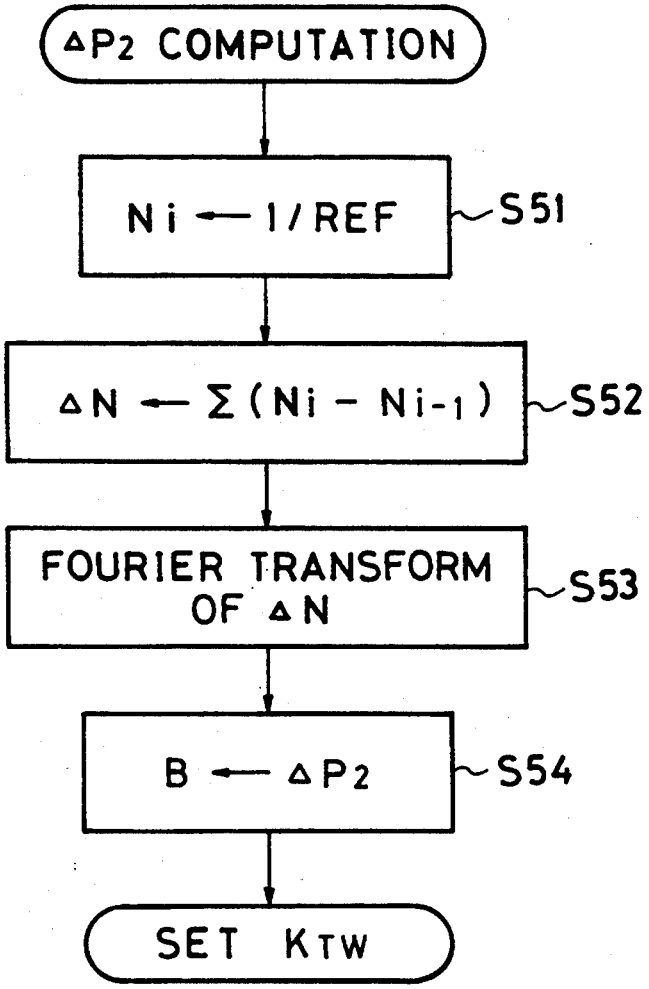
FIG. 7 is a flow chart for illustrating a routine of a second embodiment for surge-torque detection.

Explaining this in accordance with FIG. 7, first in step 51, the rotational speed Ni is obtained for each input of the reference signal REF, as a value proportional to the inverse of the REF input period.

In step 52, the sum ΔN ($=\Sigma(Ni-Ni\text{-}1)$) of the differences of the rotational speeds Ni and Ni-1 obtained in step 51 is computed.

In step 53, the Fourier transform of the sum ΔN obtained in step 52 is obtained. From this, with the period of the reference signal REF as a unit period, the levels for the various frequency components with periods of 1 to i times the unit period can be obtained.

In step 54, a level ΔP2 of a predetermined frequency component related to the surge-torque is selected from the results of the beforementioned Fourier transform, (a plurality may be selected and averaged) and stored in a memory B.

With the fuel quantity increase correction amount control apparatus for an internal combustion engine according to the present invention, the construction is such that the time constant for the reduction when reduction correcting to the fuel quantity increase correction amount while maintaining the level of the surge-torque below a predetermined level, is set to correspond to the delay time from supply of fuel until the generation of torque. As a result, control error is prevented, and good responsive obtained with the fuel quantity increase correction amount converging on an appropriate value, thus enabling an improvement with lower fuel costs and engine emissions.

Moreover, with the surge-torque detection apparatus according to the present invention, the surge-torque generation level can be detected to high accuracy over the whole operating range. Accordingly, the water temperature base increase correction coefficient may be set to an appropriate value based on the surge-torque detection value, so that an improvement such as in fuel costs and engine emissions becomes possible.

I claim:

1. A method for control of a fuel quantity increase correction amount for an internal combustion engine comprising:

a surge-torque detection step for detecting a level of surge-torque of the engine;

an increase correction amount gradual reduction control step for decrementally correcting a fuel quantity increase correction amount previously set large, while maintaining a detected surge-torque below a predetermined level;

an operating conditions detection step for detecting operating conditions of the engine;

a torque generation delay time estimation step for estimating on the basis of the operating conditions of the engine, a delay time from supply of fuel to the engine until torque is generated from combustion of said fuel; and a reduction time constant setting step for setting on the basis of the estimated delay time, a time constant for control of reduction of the fuel quantity increase correction amount by the increase correction amount gradual reduction control step.

2. A method for control of a fuel quantity increase correction amount for an internal combustion engine as claimed in claim 1, wherein said torque generation delay time estimation step comprises:

a first delay time estimation step for estimating a first delay time from supply of the fuel until said fuel reaches the combustion chamber;

a second delay time estimation step for estimating a second delay time from intake of the fuel into the combustion chamber until combustion through the compression stroke; and a summing step for summing the estimated first and second delay times, and computing an overall delay time.

3. A method for control of a fuel quantity increase correction amount for an internal combustion engine as claimed in claim 2, wherein said first delay time estimation step comprises:

a step for estimating an intake flow velocity based on an engine intake flow rate and engine rotational speed; and a step for estimating the first delay time as a functional value of the estimated intake flow velocity and an intake path length from a fuel supply point to the combustion chamber.

4. A method for control of a fuel quantity increase correction amount for an internal combustion engine as claimed in claim 2, wherein said first delay time estimation step estimates the first delay time as a functional value of the engine intake flow rate and the engine rotational speed.

5. A method for control of a fuel quantity increase correction amount for an internal combustion engine as claimed in claim 2, wherein said second delay time estimation step estimates the second delay time on the basis of engine rotational speed.

6. A method for control of a fuel quantity increase correction amount for an internal combustion engine as claimed in claim 1, wherein said reduction time constant setting step involves setting a time constant proportional to a delay time estimated by the torque generation delay time estimation step.

7. A method for control of a fuel quantity increase correction amount for an internal combustion engine as claimed in claim 1, including a fuel quantity increase correction amount learning step for continuing to store, for each termination of operation of the engine, even after termination of operation, a fuel quantity increase correction amount set at said termination time, and using this as an initial value for a subsequent operating time.

8. A method for detection of an internal combustion engine surge-torque comprising:

a combustion pressure variation detection step for detecting variable conditions of combustion pressure in a predetermined cylinder for each rotation;

a combustion pressure scatter detection step for detecting a scatter in combustion pressures occurring between a plurality of cylinders, and a surge-torque detection step for detecting a generation level of surge-torque using at least one of the detection results of said combustion pressure variation detection step, and said combustion pressure scatter detection step.

9. A method for detection of an internal combustion engine surge-torque as claimed in claim 8, wherein said combustion pressure variation detection step comprises:

a step for sampling and storing a combustion pressure for each unit period within a predetermined range of crank angle intervals during a combustion stroke of one cylinder;

a step for computing a difference amount for each said sampling, between a last stored combustion pressure Mi and a previously stored combustion pressure Mi-1, and computing and storing a sum $\Delta M$ ($=\Sigma(Mi-Mi\text{-}1)$) of the computed difference amounts from start of sampling up until the present;

a step for the Fourier transform of the sum $\Delta M$, for each computation of said sum $\Delta M$; and a step for selecting from the results of said Fourier transform, a level $\Delta P1$ of a frequency component "fn" related to the surge-torque, and storing this as a combustion pressure variation condition.

10. A method for detection of an internal combustion engine surge-torque as claimed in claim 8, wherein said combustion pressure scatter detection step comprises:

a step for reading in, for respective cylinders 1 through n, the detected values Mi1 through Min of combustion pressures occurring at identical crank angle timings (1 through i) in respective identical strokes;

a step for computing between all of the cylinders, difference amounts $\Delta Mi$ of the combustion pressures Mi1 through Min between said cylinders;

a step for the Fourier transform of said difference amounts $\Delta Mi$ for each of said respective crank angle timings (1 through i); and a step for selecting from the results of said Fourier transform, a level $\Delta P2$ of a frequency component "fm" related to the surge-torque, and storing this as a scatter in the combustion pressures between the cylinders.

11. A method for detection of an internal combustion engine surge-torque as claimed in claim 8, wherein said combustion pressure scatter detection step comprises:

a step for detecting and storing, for respective cylinders 1 through n, an engine rotational speed Ni for each identical crank angle timing in respective identical strokes;

a step for computing a difference amount between a last stored Ni and a previously stored Ni-1, and computing and storing a sum $\Delta N$ ($=\Sigma(Ni-Ni\text{-}1)$) of the computed difference amounts from start up until the present;

a step for the Fourier transform of the sum $\Delta N$ for each computation of said sum $\Delta N$; and a step for selecting from the results of said Fourier transform, a level $\Delta P2$ of a frequency component "fm" related to the surge-torque, and storing this as a combustion pressure scatter.

12. An apparatus for control of a fuel quantity increase correction amount for an internal combustion engine comprising:

surge-torque detection means for detecting a level of surge-torque of the engine;

increase correction amount gradual reduction control means for decrementally correcting a fuel quantity increase correction amount previously set large, while maintaining a detected surge-torque below a predetermined level;

operating conditions detection means for detecting operating conditions of the engine;

torque generation delay time estimation means for estimating on the basis of the operating conditions of the engine, a delay time from supply of fuel to the engine until torque is generated from combustion of said fuel; and reduction time constant setting means for setting on the basis of the estimated delay time, a time constant for control of reduction of the fuel quantity increase correction amount by the increase correction amount gradual reduction control means.

13. An apparatus for control of a fuel quantity increase correction amount for an internal combustion engine as claimed in claim 12, wherein said torque generation delay time estimation means comprises:

first delay time estimation means for estimating a first delay time from supply of the fuel until said fuel reaches the combustion chamber;

second delay time estimation means for estimating a second delay time from intake of the fuel into the combustion chamber until combustion through the compression stroke; and summing means for summing the estimated first and second delay times, and computing an overall delay time.

14. An apparatus for control of a fuel quantity increase correction amount for an internal combustion engine as claimed in claim 13, wherein said first delay time estimation means comprises:

means for estimating an intake flow velocity based on an engine intake flow rate and engine rotational speed; and means for estimating the first delay time as a functional value of the estimated intake flow velocity and an intake path length from a fuel supply point to the combustion chamber.

15. An apparatus for control of a fuel quantity increase correction amount for an internal combustion engine as claimed in claim 13, wherein said first delay time estimation means estimates the first delay time as a functional value of the engine intake flow rate and the engine rotational speed.

16. An apparatus for control of a fuel quantity increase correction amount for an internal combustion engine as claimed in claim 13, wherein said second delay time estimation means estimates the second delay time on the basis of engine rotational speed.

17. An apparatus for control of a fuel quantity increase correction amount for an internal combustion engine as claimed in claim 12, wherein said reduction time constant setting means involves setting a time constant proportional to a delay time estimated by the torque generation delay time estimation means.

18. An apparatus for control of a fuel quantity increase correction amount for an internal combustion engine as claimed in claim 12, including a fuel quantity increase correction amount learning means for continuing to store, for each termination of operation of the engine, even after termination of operation, a fuel quantity increase correction amount set at said termination time, and using this as an initial value for a subsequent operating time.

19. An apparatus for detection of an internal combustion engine surge-torque detection apparatus comprising:

combustion pressure variation detection means for detecting variable conditions of combustion pressure in a predetermined cylinder for each rotation;

combustion pressure scatter detection means for detecting a scatter in combustion pressures occurring between a plurality of cylinders, and surge-torque detection means for detecting a generation level of surge-torque using at least one of the detection results of said combustion pressure variation detection means, and said combustion pressure scatter detection means.

20. An apparatus for detection of an internal combustion engine surge-torque as claimed in claim 19, wherein said combustion pressure variation detection means comprises:

means for sampling and storing a combustion pressure for each unit period within a predetermined range of crank angle intervals during the combustion stroke of one cylinder;

means for computing a difference amount for each said sampling, between a last stored combustion pressure Mi and a previously stored combustion pressure Mi-1, and computing and storing a sum $\Delta M$ ($=\Sigma(Mi-Mi\text{-}1)$) of the computed difference amounts from start of sampling up until the present;

means for the Fourier transform of the sum $\Delta M$, for each computation of said sum $\Delta M$; and means for selecting from the results of said Fourier transform, a level $\Delta P1$ of a frequency component "fn" related to the surge-torque, and storing this as a combustion pressure variation condition.

21. An apparatus for detection of an internal combustion engine surge-torque as claimed in claim 19, wherein said combustion pressure scatter detection means comprises:

means for reading in, for respective cylinders 1 through n, the detected values Mi1 through Min of combustion pressures occurring at identical crank angle timings (1 through i) in respective identical strokes;

means for computing between all of the cylinders, difference amounts $\Delta Mi$ of the combustion pressures Mi1 through Min between said cylinders;

means for the Fourier transform of said difference amounts $\Delta Mi$ for each of said respective crank angle timings (1 through i); and means for selecting from the results of said Fourier transform, a level $\Delta P2$ of a frequency component "fm" related to the surge-torque, and storing this as a scatter in the combustion pressures between the cylinders.

22. An apparatus for detection of an internal combustion engine surge-torque as claimed in claim 20, wherein said combustion pressure scatter detection means comprises:

means for detecting and storing, for respective cylinders 1 through n, an engine rotational speed Ni for each identical crank angle timing in respective identical strokes;

means for computing a difference amount between a last stored Ni and a previously stored Ni-1, and computing and storing a sum $\Delta N$ ($=\Sigma(Ni-Ni-1)$) of the computed difference amounts from start up until the present;

means for the Fourier transform of the sum $\Delta N$ for each computation of said sum $\Delta N$; and means for selecting from the results of said Fourier transform, a level $\Delta P2$ of a frequency component "fm" related to the surge-torque, and storing this as a combustion pressure scatter.

* * * * *